US005733226A

United States Patent [19]

Chen

[11] Patent Number: 5,733,226

[45] Date of Patent: Mar. 31, 1998

[54] FOLDABLE LEG EXERCISER

[76] Inventor: Chin-Chiao Chen, No. 1146, Chung-San Rd., Ta-Chia Chen, Taichung Hsien, Taiwan

[21] Appl. No.: 843,784

[22] Filed: Apr. 21, 1997

[51] Int. Cl.[6] ..... A63B 22/00

[52] U.S. Cl. ..... 482/52; 482/51

[58] Field of Search ..... 482/51, 52, 53, 482/57, 70, 95, 96, 148, 79, 80

[56] References Cited

U.S. PATENT DOCUMENTS

| | | | |
|---|---|---|---|
| 5,584,780 | 12/1996 | Lin | 482/52 |
| 5,584,781 | 12/1996 | Chen | 482/52 |
| 5,620,400 | 4/1997 | Foster | 482/52 |
| 5,624,354 | 4/1997 | Chen | 482/51 |
| 5,643,140 | 7/1997 | Tsai | 482/52 |

*Primary Examiner*—Stephen R. Crow

*Attorney, Agent, or Firm*—Knobbe, Martens, Olson & Bear, LLP

[57] ABSTRACT

A leg exerciser includes first and second legs, and a stretcher member. The first and second legs are mounted pivotally to each other at a first pivot. Each of the first and second legs has upper and lower leg portions which are disposed respectively at two opposite sides relative to the first pivot. The stretcher member is disposed to link the first upper leg portion and the second upper leg portion in such a manner that when the first and second lower leg portions are in a straddled position, the stretcher member is in a stretched position and, when the first and second lower leg portions are in a folded position, the stretcher member is in a non-stretched position.

9 Claims, 5 Drawing Sheets

FOLDABLE LEG EXERCISER

BACKGROUND OF THE INVENTION

1. Field of the Invention

The invention relates to a leg exerciser, more particularly to a foldable leg exerciser.

2. Description of the Related Art

Conventional leg exercisers for low-impact striding are known in the art. To walk outdoors, the exercising person has to take into account weather influenced factors, whereas leg exercisers provide the required low-impact striding in addition to the swinging of the arms.

According to U.S. Pat. No. 5,536,224, there is disclosed a leg exerciser which includes a frame and a pair of striding assemblies, as best shown in FIG. 1. The frame includes a pair of base units 12, 14 adapted to be supported on a horizontal surface, and two pairs of spaced upright supports P, Q, R, S. Each of the upright supports P, Q, R, S is secured to and extends upwardly from one of the base units 12, 14. Each of the striding assemblies is mounted to a respective pair of the upright supports P, Q, R, S and includes a leg member 34, a foot platform 38, an arm member 36, a handgrip 40A, and a direct drive means. The leg member 34 is mounted pivotally to the respective pair of the upright supports P, Q, R, S at a horizontal first pivot. The foot platform 38 is mounted to the leg member 34 at a location remote from the first pivot and is adapted to support a user thereon. The arm member 36 is mounted pivotally to the respective pair of the upright supports P, Q, R, S at a horizontal second pivot which is parallel to, spaced from, and above the first pivot. The handgrip 40A is mounted to the arm member 36 at a location remote from the second pivot. The drive means interconnects the leg member 34 and the arm member 36 for concurrent movement in opposite angular directions about their respective pivots.

While above-mentioned exerciser provides beneficial effects for the user, it still suffers from the following disadvantages:

(I) The upright supports P, Q, R, S cannot be folded relative to one another, thereby occupying a relatively large storage space which is against the trend of size reduction.

(II) The exerciser is bulky and is thus difficult to transport.

SUMMARY OF THE INVENTION

Therefore, the object of this invention is to provide a foldable leg exerciser capable of overcoming the aforesaid drawbacks.

Accordingly, the leg exerciser of this invention includes first and second legs, a stretcher member, a pair of swing members, and a pedal. The first and second legs are mounted pivotally to each other at a first pivot. Each of the first and second legs has upper and lower leg portions which are disposed respectively at two opposite sides relative to the first pivot. The stretcher member is disposed to link the first upper leg portion and the second upper leg portion in such a manner that when the first and second lower leg portions are in a straddled position, the stretcher member is in a stretched position and when the first and second lower leg portions are in a folded position, the stretcher member is in a non-stretched position. The swing members include left and right upright rocking arms, and two handlebars. The left and right upright rocking arms have left and right upper ends respectively disposed outboard to and swingably suspended to distal ends of the first and second upper leg portions distant from the first pivot. The left and right upright rocking arms further have left and right lower ends. The handlebars are adjustably disposed on the left and right upper ends of the left and right upright rocking arms. The pedal includes two pieces which are respectively and transversely disposed on the left and right lower ends of the left and right upright rocking arms for supporting feet of a user and for moving the rocking arms to and fro parallel to plane of the straddled position.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
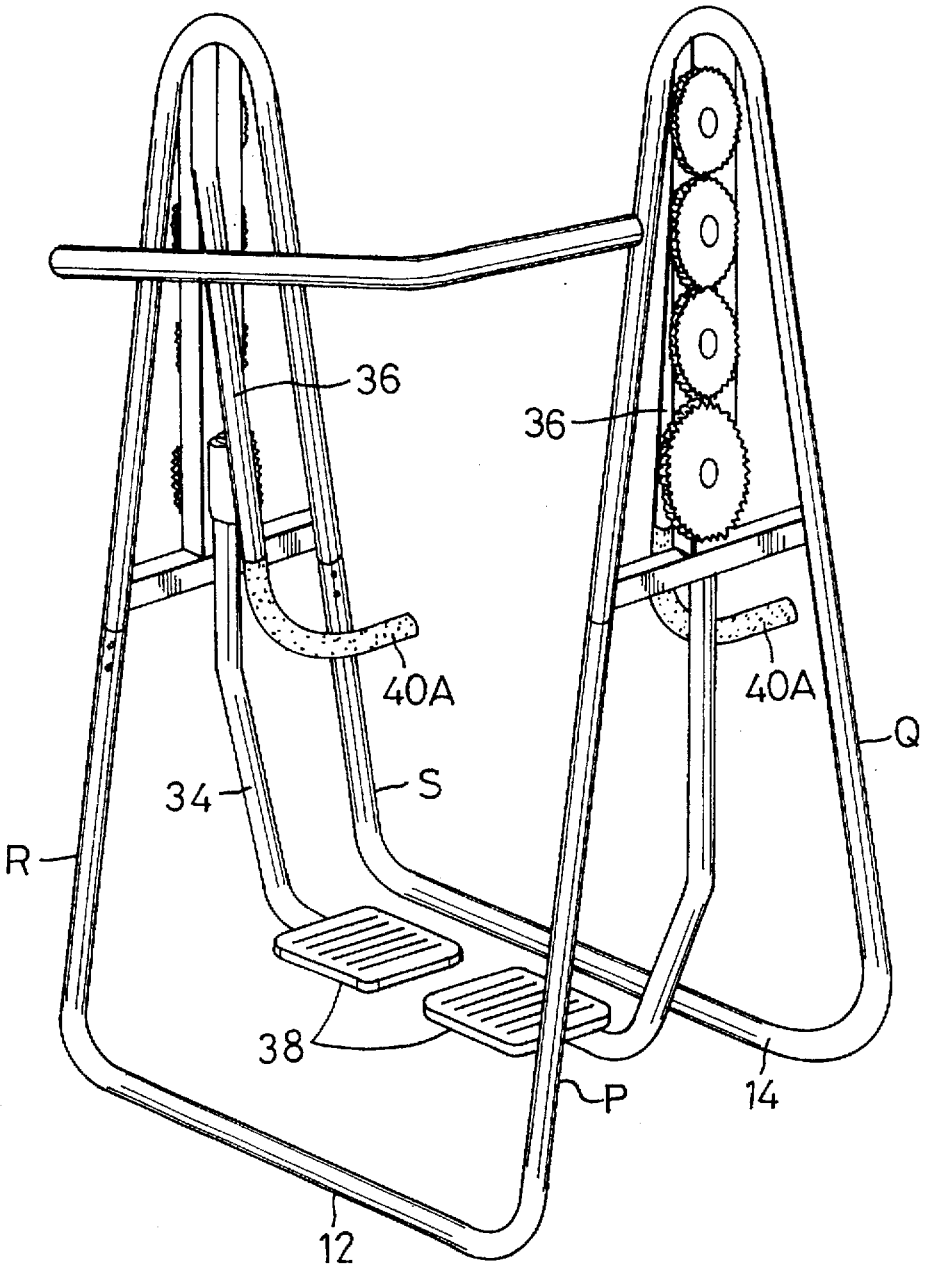
FIG. 1 PRIOR ART
FIG. 1 is a perspective and schematic view of a leg exerciser according to U.S. Pat. No. 5,536,224.
Figure 2:
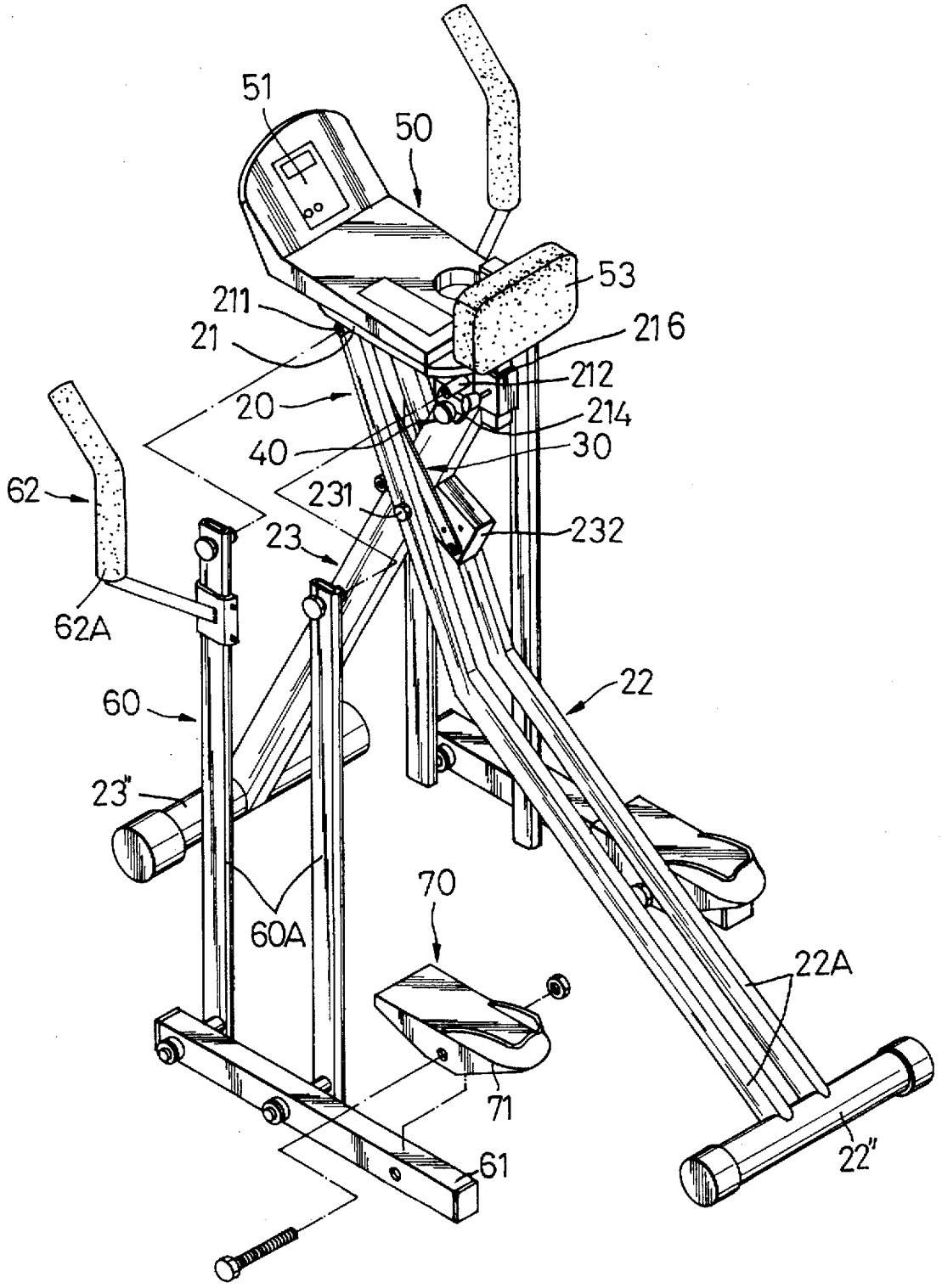
FIG. 2 is a partly exploded view of a leg exerciser of this invention.
Figure 3:
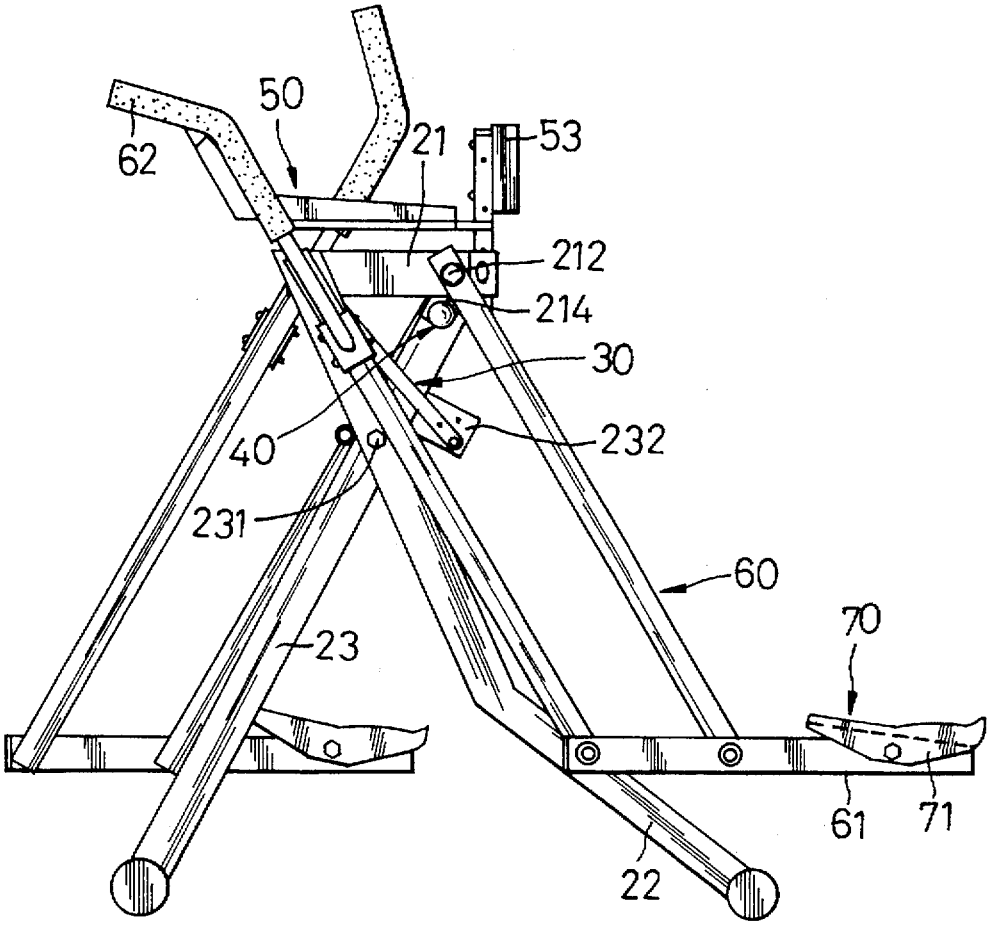
FIG. 3 is a side view of the leg exerciser of this invention.
Figure 4:
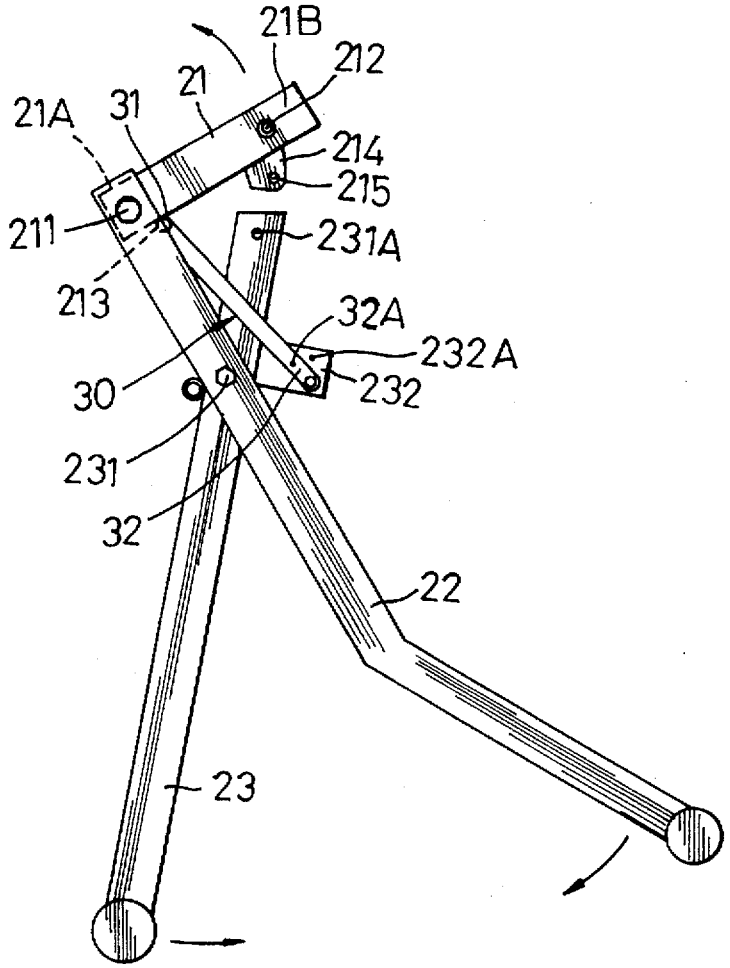
FIG. 4 illustrates a folding action of first and second legs of the leg exerciser of this invention, wherein two swing members attached thereto are removed for the sake of clarity.

Referring to FIGS. 2, 3 and 4, the preferred embodiment of a leg exerciser of this invention is shown to include first and second legs 22, 23, a stretcher member, a pair of swing members 60, and a pedal 70 consisting of two pedal pieces 71.

As illustrated, the first and second legs 22, 23 are mounted pivotally to each other at a first pivot 231 so as to form a scissor-type support stand 20. Each of the first and second legs 22, 23 has upper and lower leg portions which are disposed respectively at two opposite sides of the pivot 231. In the preferred embodiment, the first leg 22 includes two parallel leg halves 22A which extend from the bottom end thereof and which are spaced from each other so as to permit the second leg 23 to cross therebetween prior to insertion of the pivot 231. The support stand 20 further includes two elongated support members 22", 23" respectively and transversely disposed at the bottom ends of the first and second legs 22, 23 so as to provide stable support to the first and second upper leg portions of the first and second legs 22, 23 when the latter are in a straddled position.

The stretcher member includes an upper mounting plate 21, a first linking arm (not shown) and a second linking arm 30. The upper mounting plate 21 includes a proximate side 21A mounted pivotally to the first upper leg portions of the first leg 22 by means of a pin 211, and a distal side 21B. The second linking arm 30 has a linking section 32 mounted pivotally on the upper leg portion of the second leg 23 via a mounting block 232 which is fixed on the upper leg portion, and a connecting section 31 which is linked pivotally to the upper mounting plate 21 via a horizontal pin 213. The first linking arm can be separately formed relative to the upper mounting plate 21 or the second linking arm 30. However, in the preferred embodiment, the first linking arm is integrally formed with and extends in the same direction of the upper mounting plate 21 so that the proximate side 21A of the upper mounting plate 21 and the pin 213 respectively serve as the linking section and the connecting section of the first linking arm. The distal side 21B of the upper mounting plate 21 is further provided with an insert 214 which can be detachably anchored into a hole which is defined by the upper leg portion of the second leg 23. A locking pin 40 can be inserted through the holes 231A, 215 of the second leg 23 and the insert 214 of the upper mounting plate 21 so as to further secure the stretcher member in the stretched position.

Each of the swing members 60 includes left and right upright rocking arms which respectively have front and rear upright rocking rods 60A parallel to and spaced from each other, and a transverse rod 61 which is disposed between the lower ends thereof in such a manner that the transverse rod 61 extends beyond the rear upright rocking rod 60A to permit the mounting of a pedal piece 71 thereon. Two upper ends of the front upright rocking rods 60A are swingably suspended from two lateral sides of the proximate side 21A of the upper mounting plate 21 by the same pin 211 which is used to pivot the upper leg portions of the first leg 22 on the upper mounting plate 21. A pivot 212 extends through two upper ends of the rear upright rocking rods 60A and the distal side 21B of the upper mounting plate 21 such that the rear upright rocking rods 60A are swingably mounted to the upper mounting plate 21.

The handlebar 62 includes two handgrips 62A respectively and adjustably disposed on the upper ends of the front upright rocking rods 60A. The feet can be stepped on the pedal pieces 71 while the user holds the handgrips 62A to perform swinging movements of the swing members 60 relative to the support stand 20 such that the swing members 60 will swing parallel to the support stand 20.

The distal side 21B of the upper mounting plate 21 can be further provided with a vertical accommodation hole 216 which permit extension of an abdomen support 53. A dial 50 with a plurality of speedometers, like one 51 for measuring striding rate of the user or a timer, can be disposed on the upper mounting plate 21.

Figure 5:
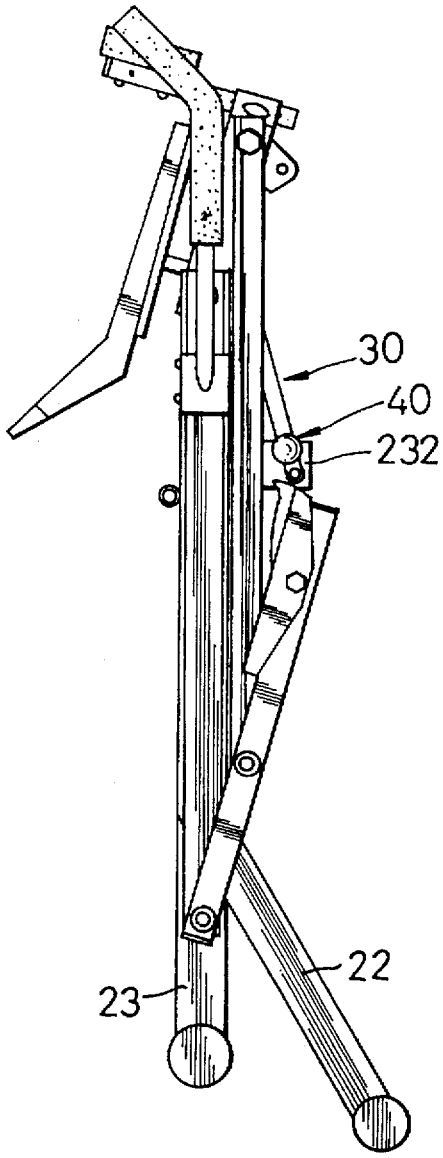
FIG. 5 shows the leg exerciser of this invention in a folded position.

As shown in FIGS. 2 and 3, when the lower leg portions of the first and second legs 22, 23 are in the straddled position, the stretcher member (i. e. the upper mounting plate 21 and the second linking arm 30) is in the stretched position. Referring to FIG. 5, when the lower leg portions of the first and second legs 22, 23 are in the folded position, the stretcher member (i.e. the upper mounting plate 21 and the second linking arm 30) is in the non-stretched position.

Referring again to FIGS. 4 and 5, when it is desired to fold the leg exerciser of this invention, the locking pin 40 (see FIG. 3) is removed from the hole 215 in the insert 214 and the hole 231A in the second leg 23, which action permits uplift and simultaneous disengagement of the upper mounting plate 21 from the second leg 23. Thus, the first leg 22 can be folded onto the second leg 23. Under this condition, a relatively small amount of space will be required to store the leg exerciser of this invention, thus facilitating the transport thereof. At this time, the locking pin 40 can be inserted into the hole 32A of the second linking arm 30 and the hole 232A of the mounting block 232 in order to retain the leg exerciser in the folded position.

With this invention thus explained, it is apparent that numerous modifications and variations can be made without departing from the scope and spirit of this invention. It is therefore intended that this invention be limited only as indicated in the appended claims.

I claim:

1. A leg exerciser comprising:

a first leg and a second leg mounted pivotally to each other at a first pivot, each of said first and second legs having upper and lower leg portions disposed respectively at two opposite sides relative to said first pivot;

a stretcher member disposed to link said first upper leg portion and said second upper leg portion in such a manner that, when said first and second lower leg portions are in a straddled position, said stretcher member is in a stretched position and, when said first and second lower leg portions are in a folded position, said stretcher member is in a non-stretched position;

a pair of swing members including:

a left and right upright rocking arms having left and right upper ends respectively disposed outboard to and swingably suspended to distal ends of said first and second upper leg portions distant from said first pivot, said left and right upright rocking arms further having left and right lower ends;

a handlebar adjustably disposed on each of said left and right upper ends; and a pedal disposed transversely on each of said left and right lower ends for supporting the feet of a user thereon and for moving said rocking arms to and fro parallel to a plane of the straddled position.

2. The leg exerciser according to claim 1, wherein said first leg is forked from a bottom end of said first lower leg portion to form two parallel leg halves which are spaced from each other so as to permit said second leg to cross therebetween for pivoting at said first pivot.

3. The leg exerciser according to claim 2, wherein said first and said second legs include first and second elongated support members respectively disposed to be transverse to said bottom ends of said first lower leg portion and said second lower leg portion so as to provide stable support thereto.

4. The leg exerciser according to claim 3, wherein said stretcher member includes a first linking arm having a first linking section pivotally mounted on said first upper leg portion of said leg halves and a first connecting section, and a second linking arm having a second linking section pivotally mounted on said second upper leg portion and a second connecting section linked pivotally to said first connecting section of said first linking arm.

5. The leg exerciser according to claim 4, further comprising an upper mounting plate having a proximate side mounted pivotally on said distal ends of said first upper leg portions of said parallel leg halves respectively, and a distal side detachably anchored to said distal end of said second upper leg portion so as to further secure said stretcher member in the stretched position, said first linking arm being integrally formed with said proximate side of said upper mounting plate.

6. The leg exerciser according to claim 5, wherein each of said left and right upright rocking arms includes front and rear upright rocking rods parallelly spaced from each other, and a transverse rod which is disposed to link lower ends of said front and rear upright rocking rods and which extends in a direction parallel to the plane of said straddled position to support said pedal.

7. The leg exerciser according to claim 6, wherein said handlebar is disposed on said upper end of said front upright rocking rod.

8. A leg exerciser according to claim 7, wherein said transverse rod extends beyond said rear upright rocking rod so as to support said pedal.

9. The leg exerciser according to claim 6, wherein two upper ends of said upright rocking rods are swingably suspended from a lateral side of said upper mounting plate, said lateral side being transverse to said proximate and distal sides of said upper mounting plate.

* * * * *